US009423131B2

(12) United States Patent
Chen

(10) Patent No.: US 9,423,131 B2
(45) Date of Patent: Aug. 23, 2016

(54) AIR MANAGEMENT ARRANGEMENT FOR A LATE LEAN INJECTION COMBUSTOR SYSTEM AND METHOD OF ROUTING AN AIRFLOW

(71) Applicant: General Electric Company, Schenectady, NY (US)

(72) Inventor: Wei Chen, Greer, SC (US)

(73) Assignee: General Electric Company, Schenectady, NY (US)

( * ) Notice: Subject to any disclaimer, the term of this patent is extended or adjusted under 35 U.S.C. 154(b) by 886 days.

(21) Appl. No.: 13/648,558

(22) Filed: Oct. 10, 2012

(65) Prior Publication Data

US 2014/0096530 A1 Apr. 10, 2014

(51) Int. Cl.

| | |
|---|---|
| ***F23R 3/34*** | (2006.01) |
| ***F23R 3/10*** | (2006.01) |
| ***F23R 3/54*** | (2006.01) |

(52) U.S. Cl.

CPC ... *F23R 3/10* (2013.01); *F23R 3/34* (2013.01); *F23R 3/346* (2013.01); *F23R 3/54* (2013.01); *F23R 2900/03043* (2013.01)

(58) Field of Classification Search

CPC ..... F23R 3/34; F23R 3/346
USPC ..... 60/733
See application file for complete search history.

(56) References Cited

U.S. PATENT DOCUMENTS

| | | | | |
|---|---|---|---|---|
| 4,928,481 | A | 5/1990 | Joshi et al. | |
| 5,687,571 | A | 11/1997 | Althaus et al. | |
| 5,802,854 | A * | 9/1998 | Maeda | F23R 3/346 60/39.821 |
| 5,983,643 | A | 11/1999 | Kiesow | |
| 6,158,223 | A | 12/2000 | Mandai et al. | |
| 7,886,545 | B2 | 2/2011 | Lacy et al. | |
| 8,112,216 | B2 | 2/2012 | Davis, Jr. et al. | |
| 2009/0071159 | A1 | 3/2009 | Parker et al. | |
| 2010/0139280 | A1 * | 6/2010 | Lacy et al. | 60/737 |
| 2010/0242482 | A1 * | 9/2010 | Kraemer et al. | 60/746 |
| 2011/0162375 | A1 * | 7/2011 | Berry | 60/746 |

FOREIGN PATENT DOCUMENTS

| | | |
|---|---|---|
| EP | 1884714 A2 | 2/2008 |

OTHER PUBLICATIONS

EP Search Report and Written Opinion dated Dec. 18, 2013, issued in connection with corresponding EP Application No. 13188114.6.

* cited by examiner

*Primary Examiner* — William H Rodriguez
*Assistant Examiner* — Scott Walthour
(74) *Attorney, Agent, or Firm* — Fletcher Yoder, PC

(57) ABSTRACT

An air management arrangement for a late lean injection combustor system includes a combustor liner defining a combustor chamber. Also included is a sleeve surrounding at least a portion of the combustor liner, the combustor liner and the sleeve defining a cooling annulus for routing a cooling airflow from proximate an aft end of the combustor liner toward a forward end of the combustor liner. Further included is a cooling airflow divider region configured to split the cooling airflow into a first cooling airflow portion and a second cooling airflow portion, wherein the first cooling airflow portion is directed to at least one primary air-fuel injector, wherein the second cooling airflow portion is directed to at least one lean-direct injector extending through the sleeve and the cooling annulus for injection of the second cooling airflow portion into the combustor chamber.

21 Claims, 4 Drawing Sheets

AIR MANAGEMENT ARRANGEMENT FOR A LATE LEAN INJECTION COMBUSTOR SYSTEM AND METHOD OF ROUTING AN AIRFLOW

BACKGROUND OF THE INVENTION

The subject matter disclosed herein relates to combustor systems, and more particularly to an air management arrangement for a late lean injection combustor system, as well as a method of routing an airflow within such a late lean injection combustor system.

In combustion applications, such as a gas turbine system, for example, a combustor section includes a combustor chamber defined by a combustor liner that is often surrounded by a sleeve, such as a flow sleeve. An airflow typically passes through a passage disposed between the combustor liner and the sleeve for cooling of the combustor liner, as well as routing of the airflow to air-fuel injectors located at a forward end of the combustor liner. The airflow is derived from an air supply that must typically also provide air to other regions for a variety of purposes. Such a region may include late lean injectors that inject air into the combustor chamber in an effort to reduce undesirable emissions into an ambient atmosphere. As late lean injection combustor systems become more prevalent and more of the air supply is employed to provide air to the late lean injectors, efforts to cool the combustor liner are hindered due to the availability of less air from the air supply to be used for cooling purposes within the passage between the sleeve and the combustor liner.

Based on the direct supply of airflow to the air-fuel injectors, a combustion system is subject to back pressure when combustion fluctuates and suddenly increases the combustion pressure. The higher pressure inside the combustor chamber will instantaneously "push" a flammable fuel/air mixture into an air supply chamber, such as a compressor discharge casing (CDC). Such flammable mixture may cause damage to the CDC and result in shut down.

BRIEF DESCRIPTION OF THE INVENTION

According to one aspect of the invention, an air management arrangement for a late lean injection combustor system includes a combustor liner defining a combustor chamber. Also included is a sleeve surrounding at least a portion of the combustor liner, the combustor liner and the sleeve defining a cooling annulus for routing a cooling airflow from proximate an aft end of the combustor liner toward a forward end of the combustor liner. Further included is a cooling airflow divider region configured to split the cooling airflow into a first cooling airflow portion and a second cooling airflow portion, wherein the first cooling airflow portion is directed to at least one primary air-fuel injector, wherein the second cooling airflow portion is directed to at least one lean-direct injector extending through the sleeve and the cooling annulus for injection of the second cooling airflow portion into the combustor chamber.

According to another aspect of the invention, a method of routing an airflow for a late lean injector combustor system is provided. The method includes directing a cooling airflow into a cooling annulus defined by a combustor liner and a sleeve surrounding at least a portion of the combustor liner, wherein the cooling airflow is routed through the cooling annulus from proximate an aft end of the combustor liner toward a forward end of the combustor liner. Also included is splitting the cooling airflow into a first cooling airflow portion and a second cooling airflow portion. Further included is routing the first cooling airflow portion to at least one primary air-fuel injector. Yet further included is routing the second cooling airflow portion to at least one lean-direct injector extending through the sleeve and the cooling annulus for injection of the second cooling airflow portion into a combustor chamber.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
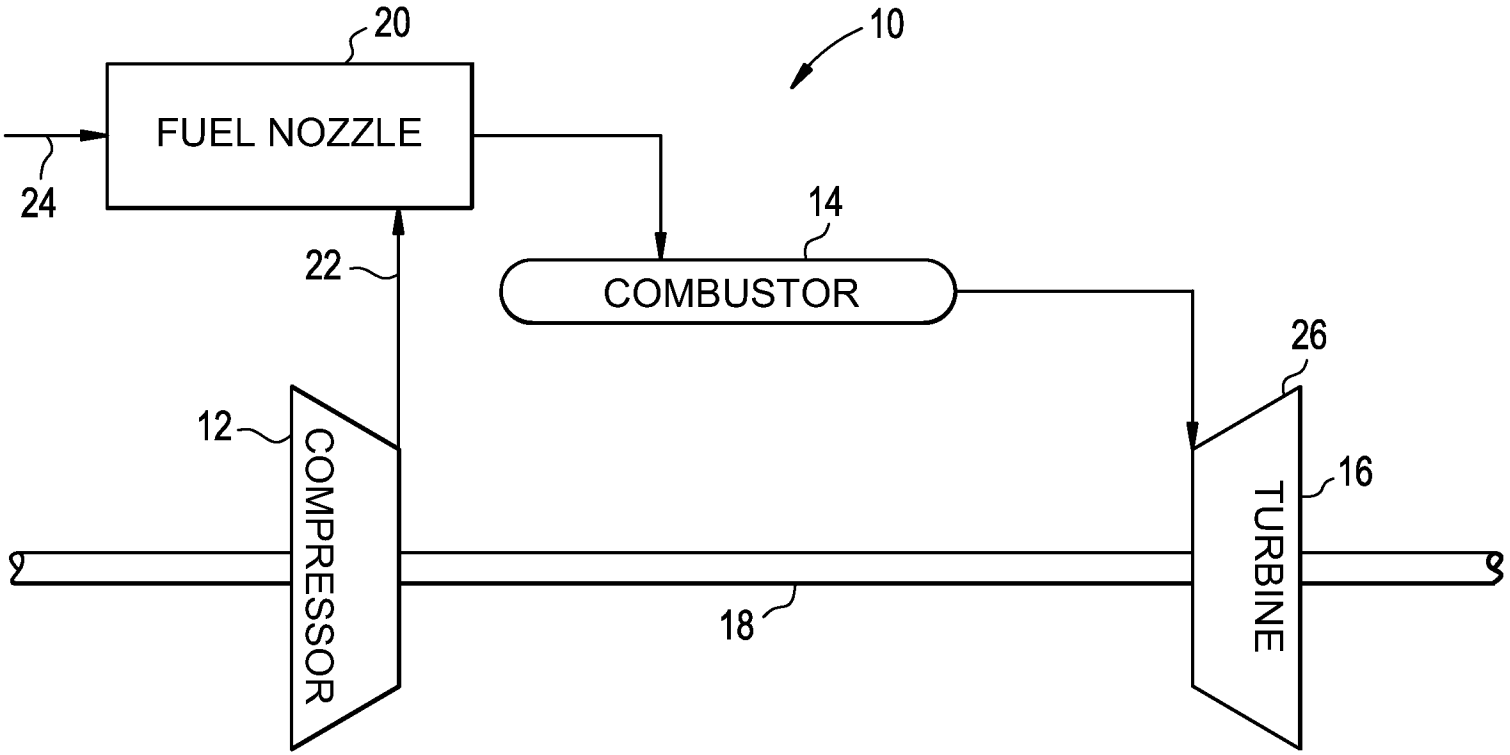
FIG. 1 is a schematic illustration of a gas turbine system.

Referring to FIG. 1, a gas turbine system is schematically illustrated with reference numeral 10. The gas turbine system 10 includes a compressor section 12, a combustor section 14, a turbine section 16, a shaft 18 and one or more air-fuel nozzles 20. It is to be appreciated that one embodiment of the gas turbine system 10 may include a plurality of compressor sections 12, combustor sections 14, turbine sections 16, shafts 18 and one or more air-fuel fuel nozzles 20. The compressor section 12 and the turbine section 16 are coupled by the shaft 18. The shaft 18 may be a single shaft or a plurality of shaft segments coupled together to form the shaft 18.

The combustor section 14 uses a combustible liquid and/or gas fuel, such as natural gas or a hydrogen rich synthetic gas, to run the gas turbine system 10. For example, the one or more air-fuel nozzles 20 may be of various types, as will be discussed in detail below, and are in fluid communication with an air supply 22 and a fuel supply 24. The one or more air-fuel nozzles 20 create an air-fuel mixture, and discharge the air-fuel mixture into the combustor section 14, thereby causing a combustion that creates a hot pressurized exhaust gas. The combustor section 14 directs the hot pressurized gas through a transition piece into a turbine nozzle (or "stage one nozzle"), and other stages of buckets and nozzles causing rotation of the turbine section 16 within a turbine casing 26. Rotation of the turbine section 16 causes the shaft 18 to rotate, thereby compressing the air as it flows into the compressor 12. In an embodiment, hot gas path components are located in and proximate the combustor section 14, where hot gas flow proximate the components causes creep, oxidation, wear and thermal fatigue of components. As the firing temperature increases, the hot gas path components need to be properly cooled to meet service life and to effectively perform intended functionality.

Figure 2:
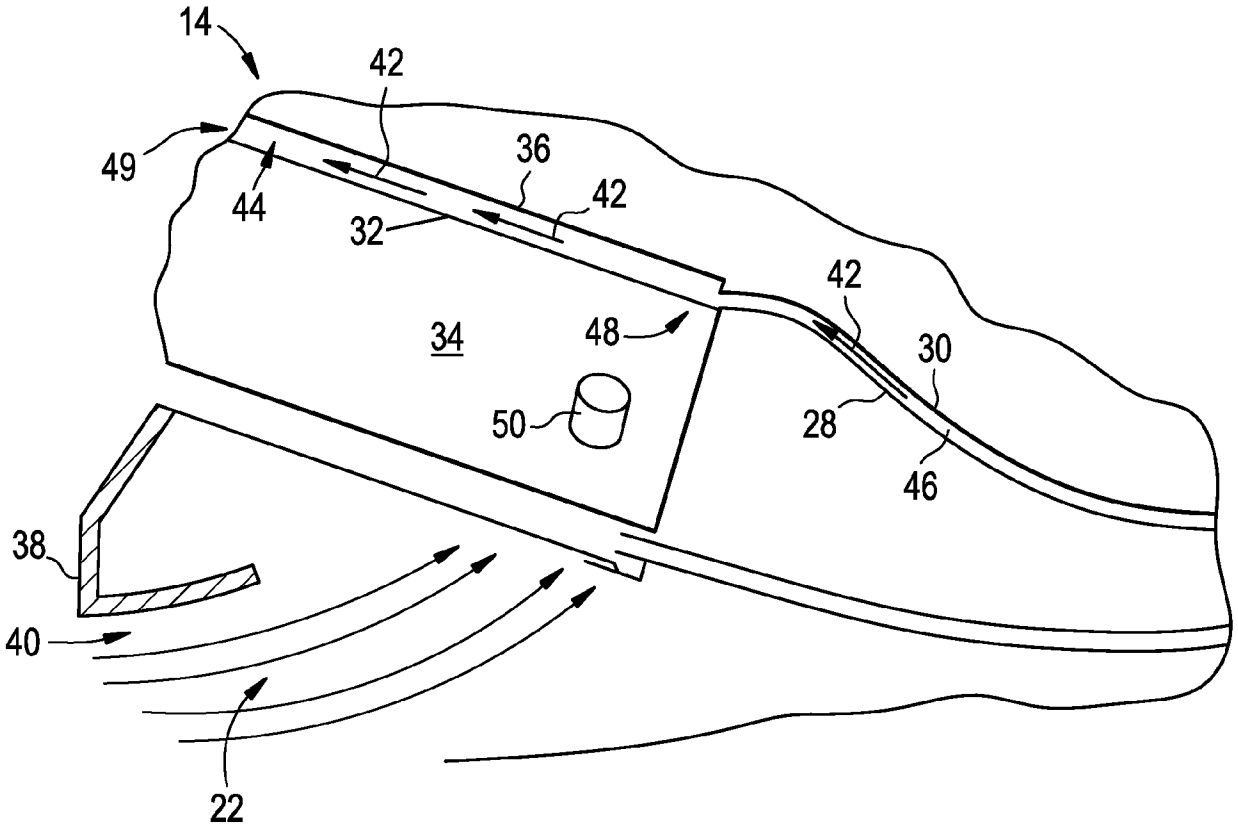
FIG. 2 is a partial schematic illustration of a combustor section of the gas turbine system.

Referring now to FIG. 2, the combustor section 14 is schematically illustrated in greater detail. The combustor section 14 includes a transition piece 28 in the form of a duct that is at least partially surrounded by an impingement sleeve 30 disposed radially outwardly of the transition piece 28. Upstream thereof, proximate a forward region of the impingement sleeve 30 is a combustor liner 32 defining a combustor chamber 34. The combustor liner 32 is at least partially surrounded by a flow sleeve 36 disposed radially outwardly of the combustor liner 32. Although the combustor liner 32 and the transition piece 28 have been described as separate components, it is to be appreciated that the combustor liner 32 and the transition piece 28 may be formed as a single, unitary structural component that forms the combustor chamber 34 and a transition zone. Similarly, although the flow sleeve 36 and the impingement sleeve 30 have been described as separate components, it is to be appreciated that the flow sleeve 36 and the impingement sleeve 30 may be formed as a single, unitary sleeve configured to surround at least a portion of the combustor liner 32 and the transition piece 28, whether separate or integrated components.

Irrespective of the precise configuration of the combustor liner 32, the transition piece 28, the flow sleeve 36 and the impingement sleeve 30, a compressor discharge casing 38 is illustrated and includes a compressor discharge exit 40 that is configured to route the air supply 22 that is employed for numerous purposes within the combustor section 14. The air supply 22 typically originates from the compressor section 12 and enters into the compressor discharge casing 38. The air supply 22 exits the compressor discharge casing 38 proximate the compressor discharge exit 40 and rushes downstream toward the transition duct 28 and/or the combustor liner 32. Specifically, rather than routing a portion of the air supply 22 directly to various components, such as air-fuel nozzles, approximately all of the air supply 22 is directed as a cooling airflow 42 to a first cooling annulus 44 defined by the combustor liner 32 and the flow sleeve 36. The cooling airflow 42 is directed within the first cooling annulus 44 from an aft end 48 of the combustor liner 32 toward a forward end 49 of the combustor liner 32. As described in detail above, various embodiments relating to the sleeve(s), as well as the combustor liner 32 and transition piece 28 configuration are contemplated, and it is to be understood that the air supply 22 may be directed as the cooling airflow 42 to a second cooling annulus 46 defined by the transition piece 28 and the impingement sleeve 30. For an embodiment having a single liner or duct defining the combustor chamber 34 surrounded by one or more sleeves, the air supply 22 may be directed as the cooling airflow 42 to such a cooling annulus. For purposes of this description, reference to the first cooling annulus 44 defined by the combustor liner 32 and the flow sleeve 36 is intended to apply to routing of the cooling airflow 42 to any cooling annulus described above.

The combustor section 14 is late lean injection (LLI) compatible. An LLI compatible combustor is any combustor with either an exit temperature that exceeds 2500° F. or handles fuels with components that are more reactive than methane with a hot side residence time greater than 10 milliseconds (ms).

Irrespective of the embodiment employed in the gas turbine system 10, at least one, but typically a plurality of lean-direct injectors ("LDIs") 50, are each integrated with or structurally supported by a plurality of housings that extend radially into at least one of the transition piece 28 or the combustor liner 32. The plurality of LDIs 50 extend through the respective component, i.e., the transition piece 28 or the combustor liner 32, to varying depths. That is, the plurality of LDIs 50 are each configured to supply a second fuel (i.e., LLI fuel) to the combustion zone through fuel injection in a direction that is generally transverse to a predominant flow direction through the transition piece 28 and/or the combustor liner 32. For each of the above-described embodiments, it is emphasized that the plurality of LDIs 50 may be disposed proximate the transition piece 28 or the combustor liner 32, in spite of the illustrated embodiments showing disposal of the plurality of LDIs 50 disposed in connection with only one of the transition piece 28 and the combustor liner 32. Furthermore, the plurality of LDIs 50 may be disposed in connection with both the transition piece 28 and the combustor liner 32. The plurality of LDIs 50 may be disposed in a single axial circumferential stage that includes multiple currently operating LDIs respectively disposed around a circumference of a single axial location of the transition piece 28 and/or the combustor liner 32. It is also conceivable that the plurality of LDIs 50 may be situated in a single axial stage, multiple axial stages, or multiple axial circumferential stages. A single axial stage includes a currently operating single LDI. A multiple axial stage includes multiple currently operating LDIs that are respectively disposed at multiple axial locations. A multiple axial circumferential stage includes multiple currently operating LDIs, which are disposed around a circumference of the transition piece 28 and/or the combustor liner 32 at multiple axial locations thereof.

Figure 3:
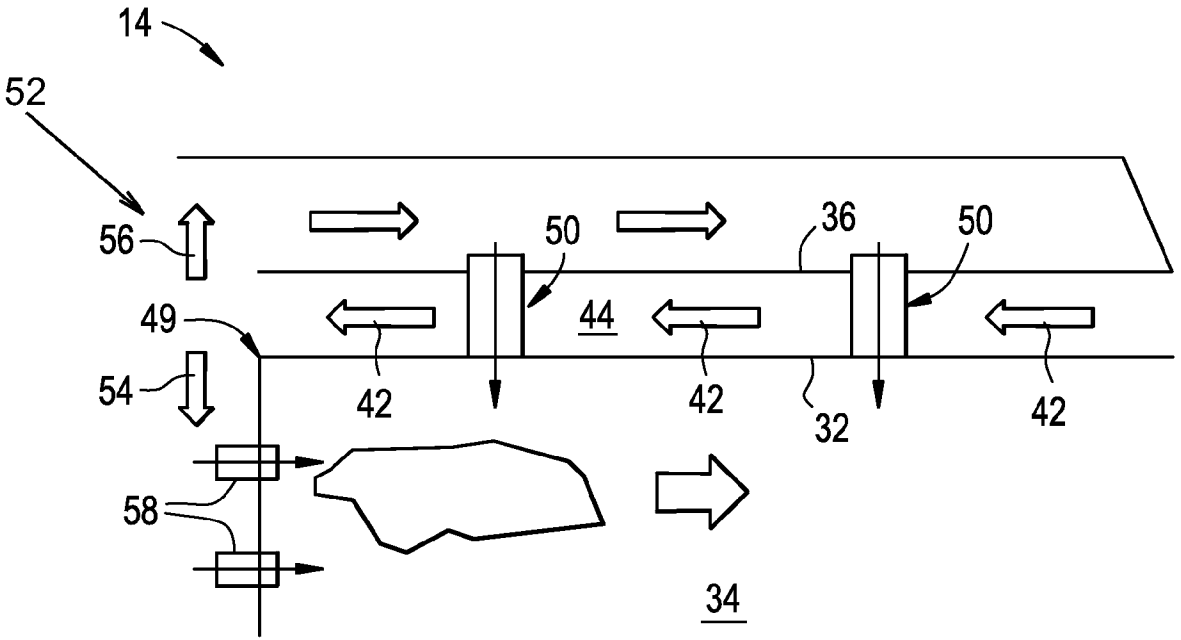
FIG. 3 is a schematic illustration of an air management arrangement for the combustor section.

Referring now to FIG. 3, the cooling airflow 42 is illustrated proximate the forward end 49 of the combustor liner 32. As shown, the cooling airflow 42 is routed toward the forward end 49 of the combustor liner 32 within the first cooling annulus 44 and around the plurality of LDIs 50. The cooling airflow 42 provides a convective cooling effect on the combustor liner 32 while flowing toward the forward end 49 of the combustor liner 32. As noted above, approximately all (i.e., about 100%) of the air supply 22 is directed to the first cooling annulus 44 for cooling purposes. Upon reaching a location proximate the forward end 49 of the combustor liner 32, a cooling airflow divider region 52, which as shown in the illustrated embodiment may simply be a walled region of the combustor section 14, splits the cooling airflow 42 into a first cooling airflow portion 54 and a second cooling airflow portion 56.

The first cooling airflow portion 54 is directed to at least one primary air-fuel injector 58 located at the forward end 49 of the combustor liner 32 for mixing and injection of an air-fuel mixture into the combustor chamber 34. The at least one primary air-fuel injector 58 is typically aligned relatively parallel to the predominant direction of flow within the combustor chamber 34. The second cooling airflow portion 56 is directed to the plurality of LDIs 50 for mixing and injection of the LLI fuel, as described above. Although illustrated and described above as being located proximate the forward end 49 of the combustor liner 32, it is to be appreciated that the cooling airflow divider region 52 may be disposed at any location along the combustor liner 32 and/or the transition piece 28, as well as any location along the flow sleeve 36 and/or the impingement sleeve 30. Specifically, the cooling airflow 42 may be split into the first cooling airflow portion 54 and the second cooling airflow portion 56 at any desired location suitable for the particular application of use. Furthermore, the combustor section 14 may include a plurality of cooling airflow divider regions and the cooling airflow 42 may be divided into more than two portions.

Routing approximately all of the air supply 22 through the first cooling annulus 44 reduces the likelihood of "flame flash back" pushing out of the combustor chamber 34 upon a sudden increase or fluctuation of combustion pressure within the combustor chamber 34. In the event of such an increase or fluctuation of combustion pressure, the path that the air-fuel mixture must travel to extend into a sensitive region subject to damage is more tortuous. Specifically, the likelihood of the air-fuel mixture reaching the compressor discharge casing 38 is reduced. Advantageously, in addition to having a longer and more tortuous path, the air-fuel mixture is provided multiple paths to flash back through. In particular, the split of the cooling flow 42 proximate the forward end 49 of the combustor liner 32 allows the air-fuel mixture being pushed back to enter the at least one primary air-fuel injector 58 or one of the plurality of LDIs 50. For example, if the air-fuel mixture is pushed out of one of the plurality of LDIs 50, the air-fuel mixture may pass to the at least one primary air-fuel injector 58 for re-entry to the combustor chamber 34.

Figure 4:
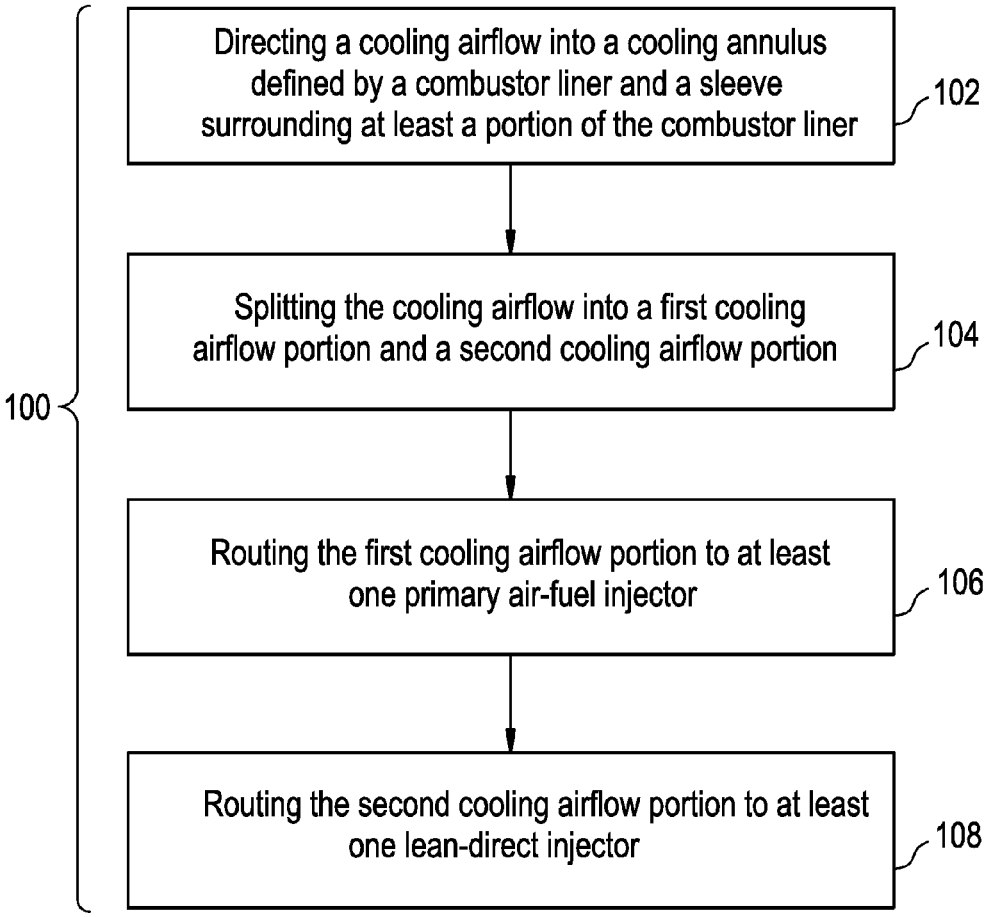
FIG. 4 is a flow diagram illustrating a method of routing an airflow for the combustor section.

As illustrated in the flow diagram of FIG. 4, and with reference to FIGS. 1-3, a method of routing an airflow for a late lean injection combustor system 100 is also provided. The gas turbine system 10 and the combustor section 14 have been previously described and specific structural components need not be described in further detail. The method of routing an airflow for a late lean injection combustor system 100 includes directing a cooling airflow into a cooling annulus 102 defined by the combustor liner 32 and a sleeve surrounding at least a portion of the combustor liner 32. The cooling airflow is split into a first cooling airflow portion and a second cooling airflow portion 104. The first cooling airflow portion is routed to at least one primary air-fuel injector 106, while the second cooling airflow portion is routed to at least one lean-direct injector 108.

Advantageously, approximately all of the air supply 22 is employed to cool various components subjected to extreme thermal conditions, such as the transition piece 28 and/or the combustor liner 32, for example. By routing the cooling airflow 42 to several air-fuel injectors, including the plurality of LDIs 50, the air supply 22 serves a dual purpose benefit. Specifically, the cooling air 42 cools various components, then is mixed with a fuel for injection to the combustor chamber 34.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method, comprising:

directing an airflow into an airflow passage disposed between a first wall and a second wall surrounding at least a portion of the first wall, wherein the first wall is disposed about a combustor chamber;

splitting the airflow from the airflow passage, at an airflow divider region, into a first airflow portion through a first airflow passage and a second airflow portion through a second airflow passage, wherein the second airflow passage is disposed radially outward from the airflow passage, and the second airflow passage extends between the second wall and a third wall disposed about at least a portion of the second wall;

routing the first airflow portion through the first airflow passage a first distance from the airflow divider region to a first air inlet of at least one primary air-fuel injector; and routing the second airflow portion through the second airflow passage a second distance from the airflow divider region to a second air inlet of at least one lean-direct injector, wherein the at least one lean-direct injector extends crosswise through the airflow passage from the second wall to the first wall.

2. The method of claim 1, wherein directing the airflow comprises routing the airflow through the airflow passage in an upstream direction opposite to a downstream direction of combustion gas flow in the combustor chamber, wherein routing the second airflow portion comprises routing the second airflow portion through the second airflow passage in the downstream direction.

3. The method of claim 1, wherein routing the first airflow portion comprises routing the first airflow portion through the first airflow passage in a radially inward direction relative to a central axis of the combustor chamber, wherein routing the second airflow portion comprises routing the second airflow portion through the second airflow passage in a radially outward direction relative to the central axis of the combustor chamber.

4. The method of claim 1, wherein the splitting the airflow comprises splitting the airflow in the airflow divider region at a first offset distance away from the at least one primary air-fuel injector and a second offset distance away from the at least one lean-direct injector.

5. A system, comprising:

a first wall disposed about a combustor chamber;

a second wall disposed about at least a portion of the first wall, wherein an airflow passage is disposed between the first wall and the second wall;

a third wall disposed about at least a portion of the second wall; and an airflow divider region that splits the airflow passage into a first airflow passage and a second airflow passage, wherein the first airflow passage extends a first distance from the airflow divider region to a first air inlet of at least one primary air-fuel injector, wherein the second airflow passage is disposed radially outward from the airflow passage and extends between the second and third walls, wherein the second airflow passage extends a second distance from the airflow divider region to a second air inlet of at least one lean-direct injector, wherein the at least one lean-direct injector extends crosswise through the airflow passage from the second wall to the first wall.

6. The system of claim 5, wherein the airflow passage extends in an upstream direction opposite to a downstream direction of combustion gas flow in the combustor chamber, and the second airflow passage extends in the downstream direction.

7. The system of claim 5, wherein the second air inlet of the at least one lean-direct injector is disposed in the second airflow passage between the second and third walls.

8. The system of claim 6, wherein the second airflow passage is substantially parallel to the airflow passage.

9. The system of claim 5, wherein the airflow passage extends a third distance from the at least one lean-direct injector to the airflow divider region.

10. The system of claim 5, wherein the airflow divider region splits the airflow passage into the first airflow passage extending radially inward relative to a central axis of the combustor chamber, and into the second airflow passage extending radially outward relative to the central axis of the combustor chamber.

11. The system of claim 5, wherein the at least one lean-direct injector is coupled to the first and second walls.

12. The system of claim 5, wherein the first wall comprises a combustor liner, a transition piece, or a combination thereof, wherein the second wall comprises a flow sleeve, an impingement sleeve, or a combination thereof.

13. The system of claim 5, wherein the first wall comprises a combustor liner and the second wall comprises a flow sleeve, wherein the at least one lean-direct injector is coupled to at least one of the combustor liner and the flow sleeve.

14. The system of claim 5, wherein the first wall comprises a transition piece and the second wall comprises an impingement sleeve, wherein the at least one lean-direct injector is coupled to at least one of the transition piece and the impingement sleeve.

15. The system of claim 5, comprising a gas turbine combustor having the first wall, the second wall, and the airflow divider region.

16. The system of claim 15, comprising a gas turbine engine having the gas turbine combustor.

17. A system, comprising:

a combustor, comprising:

a combustion chamber;

a head end chamber separated from the combustion chamber;

a first wall disposed about the combustion chamber;

a second wall disposed about the first wall;

a third wall disposed about the second wall;

a passage disposed between the first and second walls;

a first fuel injector disposed in the head end chamber;

a second fuel injector disposed in the passage;

a flow divider region that splits the passage into a first passage and a second passage, wherein the first passage extends a first distance from the flow divider region to a first inlet of the first fuel injector, and the second passage is disposed radially outward from the passage and extends between the second wall and the third wall, and the second passage extends a second distance from the flow divider region to a second inlet of the second fuel injector, wherein the second fuel injector extends crosswise through the passage from the second wall to the first wall.

18. The system of claim 17, wherein the passage extends in an upstream direction opposite to a downstream direction of combustion gas flow in the combustion chamber, and the second passage extends in the downstream direction.

19. The system of claim 18, wherein the second inlet of the second fuel injector is disposed in the second passage between the second and third walls.

20. The system of claim 17, wherein the second passage is substantially parallel to the passage.

21. The system of claim 17, wherein the flow divider region splits the passage into the first passage extending radially inward relative to a central axis of the combustion chamber, and into the second passage extending radially outward relative to the central axis of the combustion chamber.

* * * * *